United States Patent [19]

Saito et al.

[11] Patent Number: 4,463,490

[45] Date of Patent: Aug. 7, 1984

[54] COMPOSITE BORING AND HONING MACHINE AND METHOD OF MAKING THE SAME

[75] Inventors: Yoshikuni Saito, Tokyo; Hitoshi Hashimoto; Isao Arai, both of Saitama; Minoru Wada, Sayama, all of Japan

[73] Assignee: Honda Giken Kogyo Kabushiki Kaisha, Tokyo, Japan

[21] Appl. No.: 314,069

[22] PCT Filed: May 14, 1980

[86] PCT No.: PCT/JP80/00103

§ 371 Date: Oct. 19, 1981

§ 102(e) Date: Oct. 19, 1981

[87] PCT Pub. No.: WO81/02404

PCT Pub. Date: Sep. 3, 1981

[30] Foreign Application Priority Data

Feb. 26, 1980 [JP] Japan ..... 55-23181

[51] Int. Cl.[3] ..... B23P 13/00; B24B 33/08

[52] U.S. Cl. ..... 29/566.1; 29/558

[58] Field of Search ..... 29/566, 566.1, 90 R, 29/558; 408/12, 20, 21, 22, 27, 118, 158, 161, 209; 51/34 K, 34 J, 338, 339, 340; 82/2 E; 74/22, 60

[56] References Cited

U.S. PATENT DOCUMENTS

| | | | |
|---|---|---|---|
| 2,176,316 | 10/1939 | Swanson | 74/22 |
| 2,747,336 | 5/1956 | Peden | 74/60 X |
| 3,264,906 | 8/1966 | Swords | 408/12 |
| 3,405,049 | 10/1968 | Czubak | 51/338 X |
| 3,640,633 | 2/1972 | Gersch et al. | 408/12 |
| 3,973,858 | 8/1976 | Poisson et al. | 408/12 X |
| 4,175,894 | 11/1979 | Skrentner | 408/26 X |
| 4,354,305 | 10/1982 | Plummer et al. | 82/2 E X |

FOREIGN PATENT DOCUMENTS

| | | | |
|---|---|---|---|
| 12676 | of 1892 | United Kingdom | 408/161 |

*Primary Examiner*—Z. R. Bilinsky

*Attorney, Agent, or Firm*—Irving M. Weiner; Pamela S. Burt; Anthony L. Cupoli

[57] ABSTRACT

A plurality of boring cutters and honing stones are coaxially arranged on a machining head. A bar member is reciprocatingly inserted and splined within a rotary hollow spindle. Both the end opening surface of the spindle and the end of the bar member are taper-engaged with each other so that the bar member may be disengaged and moved forwardly with respect to the spindle. The machining head is coupled with the end surface of the bar member. When the spindle is taper-engaged with the bar member, a workpiece is bored. When the bar member is moved forwardly to release the taper engagement, the workpiece is honed by reciprocating the bar member and the machining head. Thus, the honing operation can be performed with a rigid structure, and both boring and honing operations can be effected by the same machining head.

9 Claims, 2 Drawing Figures

COMPOSITE BORING AND HONING MACHINE AND METHOD OF MAKING THE SAME

FIELD OF THE ART

This invention relates to a machine and a method for effecting both boring and honing with the same tool head.

BACKGROUND OF THE ART

The cylinder bore of an engine is finished by honing with grindstones after boring with cutters. The boring and honing for forming the inner peripheral surface of a work bore such as the cylinder bore has heretofore been performed in separate steps with separate tool heads mounted on separate shafts. Consequently, it is difficult to shorten the working time and to improve the working efficiency, and a great deal of machinery and devices must be provided.

Honing is performed by rotating and axially reciprocating a tool head provided with grindstones. But according to the conventional honing operation, the tool head which is reciprocated by a reciprocating mechanism is maintained in a floating state by means of a universal joint, and by this floating action the grindstones are permitted to follow the inner peripheral surface of a work bore to effect honing. Therefore, an attainable machining speed is inevitably limited, and it has thus been impossible to effect honing at high speeds and with high efficiency.

DISCLOSURE OF THE INVENTION

The present invention effectively overcomes the above-mentioned problems associated with the prior art.

It is an object of the present invention to provide a combined boring and honing machine and a method of effecting the combined machining wherein a single tool head is used in common to perform both boring and honing operations, thereby shortening the working time, improving the working efficiency and reducing the number of machinery and devices. The structure of the parts for the honing operation is made rigid enough to allow honing to be performed in a rigid state, thereby attaining a high speed and high efficiency machining.

In order to achieve the above object, this invention is characterized in that boring tools and honing stones are coaxially arranged on a tool head; a bar member is reciprocatingly inserted through a spline coupling into a hollow spindle which is rotated by drive means; an end opening surface of the spindle and an end of the bar member are tapered for engagement with each other so that the bar member may be disengaged and moved forwardly with respect to the spindle; and the aforesaid tool head is coupled with the end surface of the bar member exposed from the end opening surface of the spindle.

BEST FORM FOR WORKING THE INVENTION

Figure 1:
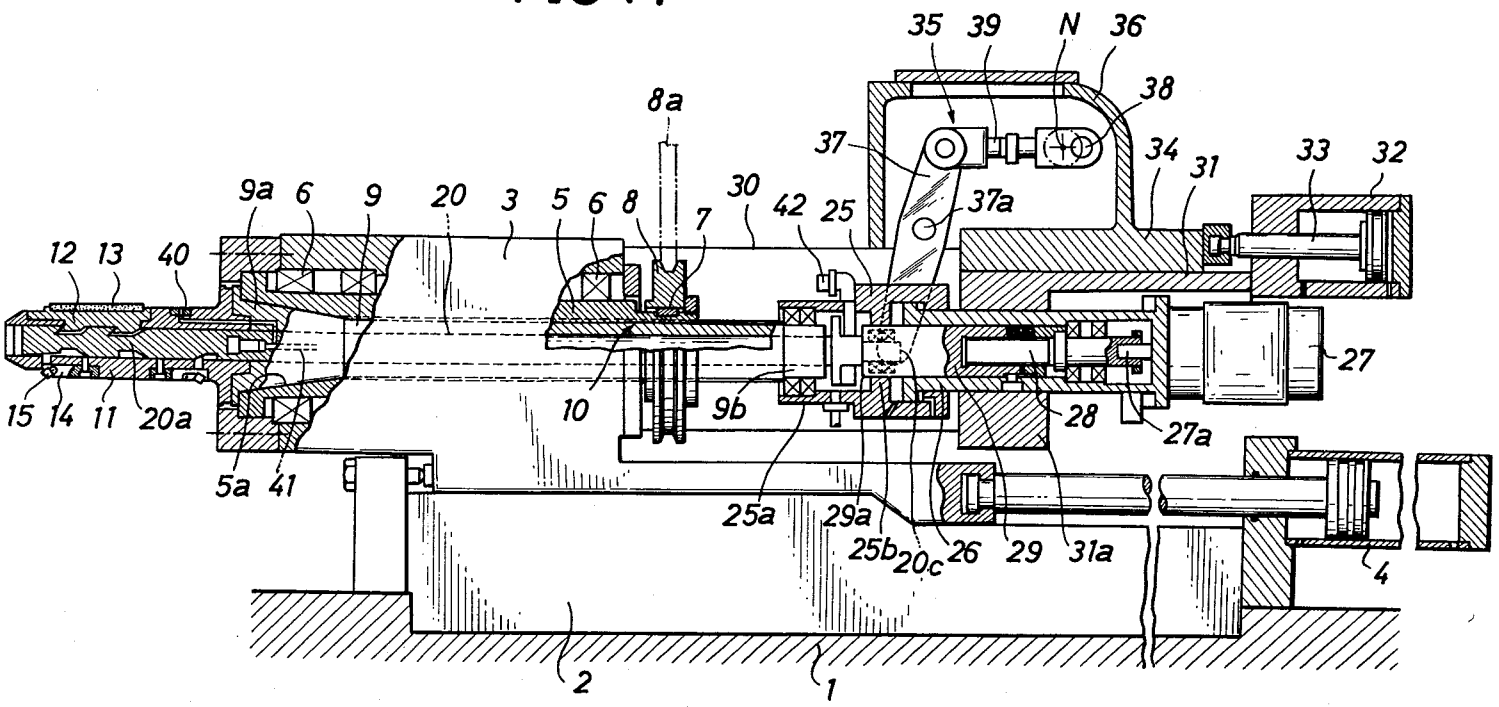
FIG. 1 is a side view of a combined machining apparatus according to this invention, with main portions in cross section.

The basic structure of a composite machine according to the invention is shown in FIG. 1. A slide base 2 is fixed onto a base 1, and on the slide base 2 there is slidably mounted a spindle case 3 which is moved forwardly and backwardly by a feed cylinder 4. Within the spindle case 3 there is rotatably mounted a hollow cylindrical spindle 5 through bearings 6, and a pulley 8 is mounted with a key 7 on a rear portion of the spindle 5 which projects from the case 3. A belt 8*a* connected to drive means such as a motor is entrained about the pulley 8, and the spindle 5 is rotated by the drive means. A bar member 9 which serves as a honing bar is inserted within the spindle 5 while the inner peripheral surface of the spindle 5 and the outer peripheral surface of the bar member 9 are each provided with splines to define a coupling 10, and by this spline coupling at 10, the bar member 9 is constructed to be slidable forwardly and backwardly with respect to the spindle 5 and rotatable together with the spindle 5.

Figure 2:
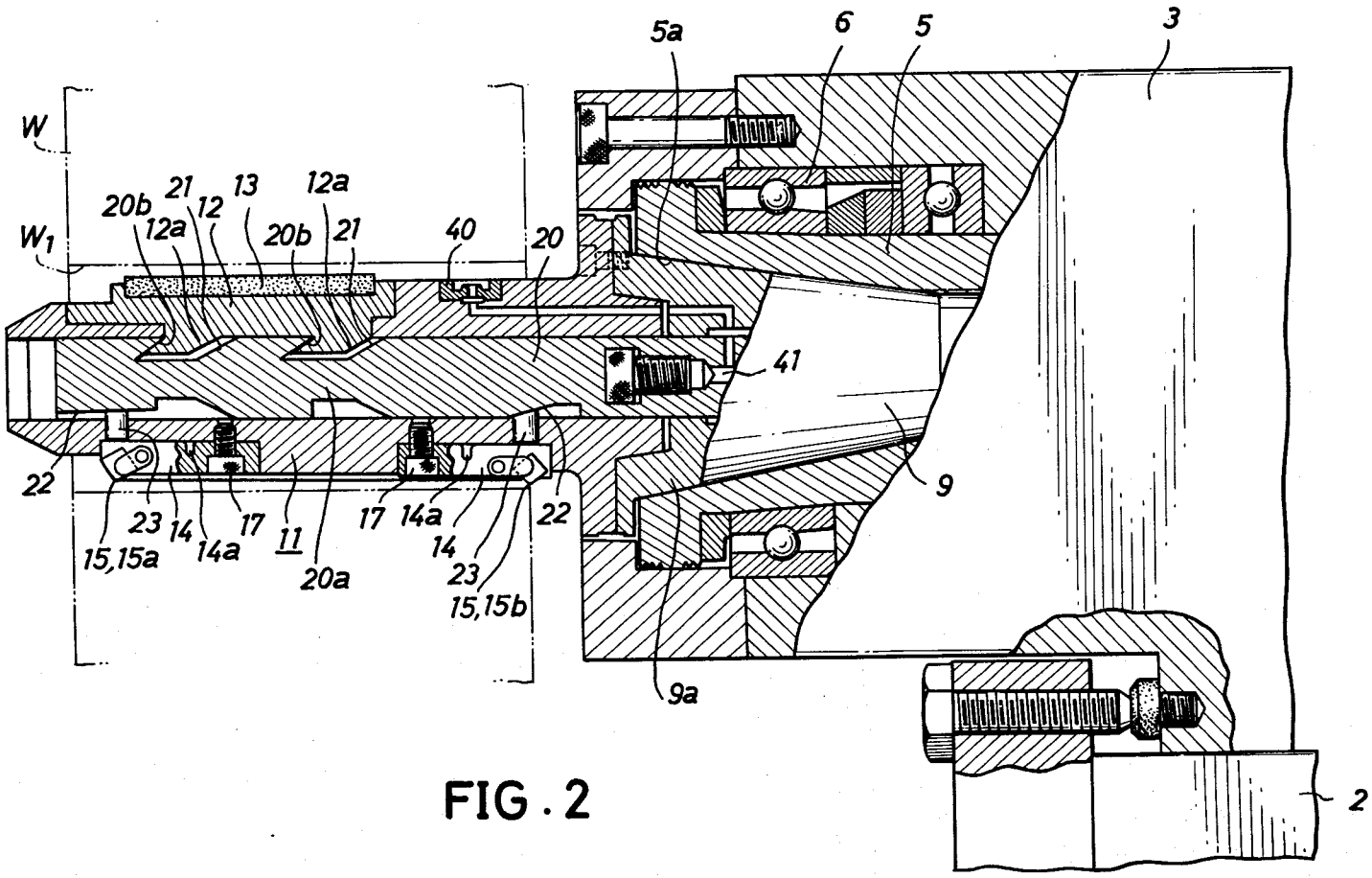
FIG. 2 is a partially enlarged view of FIG. 1, showing the tool head portion in detail.

The end opening surface of the spindle 5 is formed into a forwardly divergent, tapered surface 5*a*, and the end of the bar member 9 is also formed to have a forwardly divergent or tapered shank portion 9*a* corresponding to the tapered surface 5*a*. The tapered surface 5*a* and the forwardly divergent portion 9*a* are taper engaged when the bar member 9 is in its stroke limit of backward movement, and the taper engagement is released to allow the bar member 9 to be disengaged and moved forwardly with respect to the spindle 5 when the member 9 should move forwardly. A tool head 11 is coupled to the end surface of the bar member 9 which is exposed from the tapered opening surface 5*a* of the spindle 5, and on the head 11 there are coaxially disposed honing stones 13 held in place by shoes 12 and boring cutters 15 affixed to cartridges 14. A plurality of the honing stones 13 and the boring cutters 15 are provided in the circumferential direction of the head 11. As shown in FIG. 2, the cartridge 14 is fixed to the head 11 with a machine screw 17, and is made flexible in the radial direction by a notched portion 14*a*. In the embodiment shown, two kinds of the boring cutters 15 are provided in the front and in the rear, viz., a front cutter 15*a* for cutting the inner peripheral surface of a work bore and a rear cutter 15*b* for chamfering.

Both the bar member 9 and the tool head 11 are made hollow, and through the bar member 9 and tool head 11 is slidably inserted a rod 20, with inclined cam surfaces 21 and 22 being formed on a cone portion 20*a* at the end of the rod 20 inserted in the interior of the tool head 11. The directions of inclination of both cam surfaces 21 and 22 are made opposite to each other with respect to the sliding direction of the rod 20. In this embodiment, as the rod 20 moves forwardly, one cam surface 21 abuts a cam projection 12*a* of the honing stone shoe 12 projecting toward the interior of the tool head 11, whereby the honing stone 13 is pushed radially outwardly from the head 11; while a backward movement of the rod 20 allows the cam surface 22 to deflect the cartridge 14 through a push pin 23, whereby the boring cutter 15 is pushed radially outwardly from the head 11.

The cam projecting 12*a* comes into slantwise engagement with an engaging concavity 20*b* of the rod 20, and the rotational centrifugal force of the stone 13 during honing is supported by the engaging action between the cam projection 12*a* and the concavity 20*b*, whereby the stone 13 is positively prevented from jumping out even at high speed rotation of the tool head 11.

As shown in FIG. 1, a cylinder 25 is provided behind the spindle case 3, and a front portion 25*a* of the cylinder 25 is coupled with a rear portion 9*b* of the bar member 9 extending from the rear end of the spindle 5 so as to permit rotation of the bar member 9. In the cylinder 25 there is fitted an end of a piston 26, the greater part of which extends rearwardly from the cylinder 25. To the rear end of the piston 26 there is affixed a pulse motor 27 for adjusting the position of the rod 20 and correcting the push-out amount of the boring cutter 15, and a threaded rod 28 connected to a driving shaft 27*a* of the motor 27 is incorporated within the interior of the piston 26 which is hollow. The rod 28 is threadedly engaged with a reciprocative member 29 having an internally threaded hole provided at the rear thereof. An end portion of the reciprocative member 29 extends forwardly through the front end of the piston 26 and through a partition wall 25*b* of the cylinder 25, and the extending end portion 29*a* of the reciprocative member 29 is coupled with a rear portion 20*c* of the rod 20 which extends from the rear end of the bar member 9 so as to permit rotation of the rod 20, whereby the piston 26 and the rear portion 20*c* of the rod 20 are coupled together through the pulse motor 27 which constitutes correcting drive means.

The piston 26 is supported by a drop portion 31*a* of a supporting member 31 which is integrally coupled with the spindle case 3 through a coupling member 30, and the piston 26 is slidable through a hole formed in the drop portion 31*a*. To the rear of the supporting member 31 there is affixed a honing cylinder 32 containing a piston 33 which is coupled with a slide plate 34 adapted to slide over the supporting member 31, and by the operation of the cylinder 32 the slide plate 34 is moved forwardly and backwardly. The slide plate 34 is formed as a part of a case 36 which incorporates a reciprocating mechanism 35, and an end portion of a rocking arm 37 which is a component of the reciprocating mechanism 35 is connected to the cylinder 25, whereby the rear portion 9*b* of the bar member 9 and the reciprocating mechanism 35 are connected together through the cylinder 25.

In the outer peripheral surface of the tool head 11 there is disposed an air nozzle 40 which is connected to a pressure air source through the head 11, the interior of the bar member 9, an air passage 41 formed longitudinally in the axis of the rod 20 and an air supply port 42 formed at the rear portion of the rod 20, to eject air from the nozzle 40. The air nozzle 40 is provided for detecting the size of a work bore under machining, and this size detection is effected on the basis of the amount of air flowing through the air circuit or back pressure. The air output is converted to an electrical output which is digitized and further converted to a pulse signal, and this pulse signal is input to the pulse motor 27.

The following description relates to the machining operation.

The piston 26 is retreated by supplying a hydraulic oil to the cylinder 25. The pulse motor 27, the threaded rod 28 and the reciprocative member 29 also move backwardly integrally with the piston 26. As the reciprocative member 29 retreats, the rod 20 moves back within the bar member 9, whereby the boring cutters 15 are pushed out from the head 11. When the spindle 5 is rotated through the foregoing drive means, the belt 8*a* and the pulley 8, the bar member 9 which is splined at 10 with the spindle 5 and the tool head 11 coupled with the bar member 9 are rotated. By the operation of the feed cylinder 4, the spindle case 3 is rotated while being moved forwardly, thus allowing the tool head 11 to be inserted into a bore $W_1$ of a workpiece W which is held in place by clamp means (not shown), so that the inner peripheral surface of the bore $W_1$ undergoes boring with the cutters 15.

After cutting the overall length of the bore $W_1$ with the cutters 15, the finished diameter of the bore $W_1$ is detected by the injection of air from the air nozzle 40. Next, the detected value is compared with a reference value and the difference is converted to a pulse signal in an electrical circuit, which pulse signal is input to the pulse motor 27. The motor 27 rotates by the number of times corresponding to the input pulses and this rotation is transmitted to the threaded rod 28. Then, by the action of the feed screw, the reciprocating member 29 advances or retreats with respect to the piston 26 to adjust the position of the rod 20 and correct the push-out amount of the boring cutters 15.

The above correction for the boring cutters 15 is performed when the size of the bore $W_1$ of the workpiece W cut by the cutters 15 is outside the tolerance, and the effect of this correction appears on the workpiece to be machined next.

The above boring operation is performed with the divergent front portion 9*a* of the bar member 9 in close contact with the tapered surface 5*a* of the end opening surface of the spindle 5, so that the shaft rigidity of the bar member 9 provided at the end thereof with the tool head 11 is enhanced by the spindle 5 and the boring accuracy is greatly improved.

After the rotation of the spindle 5 is stopped and the boring operation with the cutters 15 is complete, the piston 26 is advanced to a nearly intermediate position of the cylinder 25 to let the cutters 15 escape from the machined bore $W_1$ of the workpiece W. Then, the spindle case 3 is retreated by a return motion of the feed cylinder 4 and the tool head 11 is drawn out from the bore $W_1$. The retreating stroke of the spindle case 3 is made coincident with the stroke for disengaging the bar member 9 from the spindle 5 and moving it ahead in the following honing operation.

For effecting the honing operation, first the piston 33 of the honing cylinder 32 is urged to move in an expansive manner thereby allowing the slide plate 34 to slide ahead on the supporting member 31. As a result, the reciprocating case 36 integral with the slide plate 34 and the reciprocating mechanism 35 incorporated in the case 36 also advance together, so that the cylinder 25 connected to the rocking arm 37 of the reciprocating mechanism 35 moves forwardly. Because the rear portion 9*b* of the bar member 9 is connected to the cylinder 25, the bar member 9 undergoes an advancing force and slides forwardly with respect to the spindle 5 by the spline coupling at 10, so that the divergent front portion 9*a* disengages from the forwardly divergent, tapered surface 5*a* of the spindle 5 and the advancement of the bar member 9 allows the machining head 11 to again enter the bore $W_1$ of the workpiece W.

The piston 26 which has been advanced to an intermediate position of the cylinder 25 is further advanced, and the resulting forward movement of the rod 20 allows the honing stone 13 to be pushed radially outwardly and be brought into pressure contact with the bore $W_1$. This pressure contact is effected by rotating the spindle 5 and by actuation of the reciprocating mechanism 35. The reciprocating mechanism 35 includes, in addition to the rocking arm 37, a crank shaft 38 which rotates about an axis N and a rod 39 which connects the crank shaft 38 to the rocking arm 37. The crank motion is converted to a longitudinal rocking motion about a pivot 37*a* of the rocking arm 37. According to this rocking motion of the rocking arm 37, the cylinder 25, the piston 26, the bar member 9, the tool head 11 and further the rod 20 together repeat advancement and retreat. Because the spindle 5 is under rotation, this repetitive motion is performed under rotation of the bar member 9 and the tool head 11, so that the honing stone 13 grinds the inner peripheral surface of the bore $W_1$ in a crossed spiral manner and thus honing is effected.

The above honing operation is performed while the bar member 9 is reciprocated within the spindle 5 through the spline coupling at 10 and while it is guided by the spindle 5. Therefore, unlike the conventional structure, the tool head 11 is not in a floating state, that is, the bar member 9 and the head 11 can be reciprocated while attaining their rigidity, so that the honing accuracy is improved. Furthermore, because the head is not floating, the reciprocative machining speed can be made higher and a high speed, high efficiency machining becomes attainable.

POSSIBILITY OF INDUSTRIAL UTILIZATION

This invention is utilized for forming the inner peripheral surface of a work bore to be first subjected to boring and then to honing such as the cylinder bore of an engine. According to this invention both boring and honing can be performed with the same tool head. Furthermore, the honing speed can be made higher and a high speed, high efficiency machining is attainable.

We claim:

1. A boring and honing machine, comprising:

a slide base;

a spindle case slidably supported on said slide base;

a spindle rotatably supported in said spindle case;

said spindle being hollow and provided with splines on the inner surface thereof, and having a tapered opening defined at one end thereof;

a bar member fitted in said hollow spindle;

said bar member being provided with splines engaging with said splines of said spindle such that said bar member is axially slidable relative to said spindle and integrally rotatable with said spindle;

said bar member being provided with a tapered shank defined adjacent one end thereof;

a tool head mounted on said tapered shank of said bar member, said tool head having boring tools and honing stones disposed coaxially thereon;

drive means for rotating said spindle;

first reciprocating means for reciprocating said bar member relative to said spindle when honing a workpiece;

second reciprocating means for reciprocating said bar member together with said spindle when boring the workpiece; and said tapered shank of said bar member and said tapered opening of said spindle being engaged with each other during boring of the workpiece and being disengaged from each other during honing of the workpiece.

2. A boring and honing machine according to claim 1, wherein:

said first reciprocating means is mounted on said spindle case;

said first reciprocating means and said bar member are connected with each other while permitting rotation of said bar member; and said second reciprocating means is mounted on said slide base and connected to said spindle case so as to reciprocate said spindle case.

3. A boring and honing machine according to claim 1, wherein:

said bar member is hollow;

said tool head is hollow;

a rod is fitted in said bar member;

expander cone means are provided at one end of said rod and disposed inside said tool head, for selectively expanding said boring tools and said honing stones outwardly of said tool head upon axial movement of said rod in relation to said bar member; and said machine further comprises means for axially moving said rod in relation to said bar member, including a cylinder connected with said bar member while permitting rotation of said bar member, a piston connected with said rod while permitting rotation of said rod and fitted in said cylinder, and hydraulic means for moving said piston in relation to said cylinder.

4. A boring and honing machine according to claim 3, wherein:

said rod is axially movable in forward and rearward directions; and said expander cone means comprises a cone portion provided at said one end of said rod, said cone portion having an inclined cam surface for pushing out said boring tools and an inclined cam surface for pushing out said honing stones, with the directions of inclination of both said cam surfaces being opposite to each other with respect to the sliding direction of said rod.

5. A boring and honing machine according to claim 3, wherein:

each said honing stone disposed on said tool head is supported by a shoe, each said shoe having a projection which projects to the interior of said tool head;

said cone portion has a concave portion adapted to engage each said projection; and the rotational centrifugal force of said honing stone is supported by the engagement of each said projection and each said concave portion.

6. A boring and honing machine according to claim 3, further comprising:

means for adjusting the position of said rod so as to correct the push-out amount of said boring tools; and said adjustment means being interposed between said rod and said piston.

7. A boring and honing machine according to claim 6, wherein:

said adjusting means comprises a pulse motor mounted on said piston, a reciprocating member connected to said rod and operatively cooperating with said pulse motor so as to be reciprocated thereby, an air nozzle provided in said tool head for detecting the size of a bore of the workpiece finished with said boring tools, and means for generating a pulse signal for said pulse motor in response to a detected value from said air nozzle.

8. A boring and honing machine according to claim 3, wherein:

said first reciprocating means is mounted on said spindle case;

said first reciprocating means and said bar member are connected with each other while permitting rotation of said bar member; and said second reciprocating means is mounted on said slide base and connected to said spindle case so as to reciprocate said spindle case.

9. A method for using a boring and honing machine having a tool head provided with boring tools and honing stones, comprising the steps of:

boring a workpiece with said boring tools while a bar member having said tool head mounted on a front surface thereof, and slidably fitted in a rotatable hollow spindle, is taper-engaged with said spindle in a rearmost position of said bar member; and advancing said bar member with respect to said spindle to release said taper engagement so as to perform a honing operation with said honing stones.

* * * * *